United States Patent [19]

Telang

[11] 3,964,145

[45] June 22, 1976

[54] APEX SEAL MATERIAL

[75] Inventor: Yeshwant P. Telang, Grosse Ile, Mich.

[73] Assignee: Ford Motor Company, Dearborn, Mich.

[22] Filed: Mar. 6, 1974

[21] Appl. No.: 448,797

[52] U.S. Cl. ..... 29/182; 29/182.1; 75/153; 75/200; 75/221; 75/226; 148/126; 418/179

[51] Int. Cl.[2] ..... B22F 3/00; B22F 5/00; B22F 1/04; F01C 21/00

[58] Field of Search ..... 418/179, 113; 29/182, 29/182.1; 75/211, 153, 200, 221, 226; 148/126

[56] References Cited

UNITED STATES PATENTS

| | | | |
|---|---|---|---|
| 2,789,901 | 4/1957 | Shipe et al. | 29/182.1 |
| 3,459,547 | 8/1969 | Andreotti et al. | 29/182.1 |
| 3,756,754 | 9/1973 | Sakamaki | 418/179 X |
| 3,773,504 | 11/1973 | Niimi et al. | 75/153 |
| 3,869,259 | 3/1975 | Lindsey | 29/182.8 |
| 3,909,310 | 9/1975 | Uy | 418/179 X |
| 3,910,734 | 10/1975 | Telang | 418/179 X |

*Primary Examiner*—Benjamin R. Padgett
*Assistant Examiner*—Josephine Lloyd
*Attorney, Agent, or Firm*—Keith L. Zerschling; Joseph W. Malleck

[57] ABSTRACT

A method of making and the resulting metallurgical product for an apex seal design and/or opposing rubbing surface is disclosed; the seal has ingredients so that it is effective to inherently contain a lubricating film have a retrograde solubility curve so that small additions of chromium can precipitate to achieve a hardening of the matrix, and in some instances an independent graphite lubricant is admixed. A specific example of the composition is a copper-based alloy having 0.1–0.6% chromium and 0.5–1.5% by weight graphite.

4 Claims, No Drawings

APEX SEAL MATERIAL

BACKGROUND OF THE INVENTION

Many attempts have been made to improve the performance at the sealing surfaces of a rotary-type combustion engine. Typically, such an engine has a rotor defined with a number of circumferentially spaced apex portions having radially movable seal strips mounted within slots thereof for sealing engagement with the surrounding inner surface of the rotor housing. The rotor housing inner surface is typically of an epitrochoid configuration and is usually uninterrupted except for small ports defining areas for spark introduction admitting a fuel/air mixture or emitting exhaust.

Lubrication is essential to most engines for reducing wear at the contacting surfaces of the piston seal means and the cylinder walls. The lubrication problem in a piston engine is relatively simple in solution because of the reciprocating action of the piston which continuously bathes the cylinder walls with oil while preventing the oil from entering into the combustion zone of the engine. However, in a rotary combustion engine, the solution is not as simple since the oil becomes exposed to the combustion zone of the engine and will be consumed as it is introduced between apex seals and the inner surface of the rotor housing. The effectiveness of the oil as the lubricating film is rapidly reduced by the high operating temperatures in the rotary combustion engine. It has become known that due to the high temperatures and pressures at the mating sealing surfaces, and particularly the apex sealing surfaces, an oil film does not always satisfactorily prevent metal to metal contact which may result in a relatively rapid rate of wear at the metal contacting surfaces. This has been found to be a relatively serious problem during the break in period.

To provide apex seals without the need for oil, various types of wear-resistant materials have been tried. One group of such materials has been preferentially formed by compacting metal powders followed by sintering operations; various combinations of powdered aluminum with carbon have been used, iron-titanium carbide mixtures have been used, and also hot pressed silicon nitride. In addition, various types of alloys have been employed and tool steel has been impregnated with graphite and various types of unusually hard wear-resistant ceramic coatings have been applied by plasma or flame-spray techniques. The cost or performance of such materials have not been optimal because of the difficulty of finding an opposing material for the seal to compatibly engage and with the difficulty of inherently achieving both lubrication and wear resistance in a single material.

The seal means carried by the rotor are in constant rubbing engagement with the inner surfaces of the peripheral wall and end walls. As will be apparent, the constant relative rubbing engagement between the seal members and the inner surface can result in serious wearing problems of these elements and can ultimately terminate the useful life of the engine.

For example, one common solution to the compatibility problem has been to provide a liner of wear-resistant compatible material on the inner surface of the rotor housing. Such materials as hard chromium plated plating, or a carbide liner has been employed. But the use of liners or coatings has not been totally satisfactory because of non-uniform heat dissipation and gas loading characteristics of rotary combustion engines. There is resulting tendency for the liners to separate from the housing base material and in many cases the liners do not achieve the appropriate wear improvement sought.

SUMMARY OF THE INVENTION

One of the objects of this invention is to provide a method of making and the resulting metallurgical composition for an apex seal design and/or the mating engaging surface for such apex seal which meets two characteristics: inherently carries a lubricating film not requiring a special additive layering and has a retrograde solubility curve such that small additions of chromium can be precipitated to achieve a hardening of the matrix.

Still another object of this invention is to provide a metallurgical composition for an apex seal design, and/or the engaging surface for such seal, which contains additions of special lubricating agents as well as having an inherent lubricating agent as part of the metallurgical matrix while at the same time allowing for precipitation hardening to take place with a variety of ingredients, particularly chromium.

Yet still another object of this invention is to provide a metallurgical material for an apex seal design which meets the above objects and also can be fabricated by powder metallurgy techniques. A specific starting composition meeting the above objects is a copper-based alloy having 0.1–0.6% chromium and 0.5–1.5 graphite which has been cold compacted and vacuum sintered at 1500°–1800°F, followed by quenching and aging at 400°–600°F to precipitation harden.

DETAILED DESCRIPTION

A preferred metallurgical composition and method for achieving the objects of this invention comprises the use of a pre-alloyed powder ingredient having a chemistry consisting of a copper base with additions of 0.1–0.6% chromium. The prealloyed powder has a particle size in the range of 100–325 mesh. A separate graphitic powder (particle size in the range of 100–325) is blended with the pre-alloy powder to form a powder charge for processing according to powder metallurgy techniques. The blend is compacted to a density of at least 60%, preferably while in the heated condition in the range of 300-1800°F after having added sufficient lubricant, if desired, such as zincstearate to aid in die release after compaction. The compacted body may then be sintered to an integral structure at a temperature preferably in excess of 2050°F (although conventional sintering temperatures of 1500°–1800°F may be used) and aged at a temperature in the range of 400°–600°F to precipitate the chromium in said matrix.

Copper is an excellent base constituent having the characteristics of light weight, good heat conduction, and provides an inherent metallic film lubricant. The latter results from the formation of a surface oxide film on copper which is no deterrent to the performance of the apex seal because the copper oxide is soft and provides a lubricating function so essential for operating as an apex seal.

Additionally, a copper-chromium phase diagram illustrates a retrograde solubility for chromium. This reduction in solubility at lower temperatures produces a precipitation hardening of the copper alloy rendering a surface hardenability in the range of 50–75 $R_B$. The use of chromium additions provides the maximum hardening achievable with copper. This composite material is desirable in an apex seal since it tends to be compatible with a variety of hard materials, such as chromium or nickel-silicon carbide material types.

Two important points should be adhered to in producing the final sintered compact, namely: (a) the use of vacuum or hydrogen atmosphere in the sintering of the powdered metal to achieve high compressive strength and (b) the control of the thermal expansion of the powder compact during sintering to less than 0.01 inch by regulating the particle size to a narrower range of 200–325 mesh and density of compaction to a narrower range of 80–90%.

To achieve the high strength required of a structural part composed of powder, the compact should be sintered to a temperature well above the conventional 2000°F and approaching the area of 2300°F. Additionally, high purity, low due point atmospheres, such as hydrogen or dis-associated ammonia, are essential. The use of a vacuum sintering furnace permits the high operating temperature to be utilized upwards to 2300°–2320°F and this increases the density of the powdered metal part resulting in a stronger product, particularly in compressive strength. Present day muffle furnaces are uneconomical to operate above 2100°F because of the low structural strength of the muffle alloy.

In considering the vacuum sintering approach, the metallic elements of the pre-alloyed powder have definite vapor pressures at definite pressures and so do their compounds. Therefore, if the pressure within an evacuating chamber is less than the dis-association pressure, the compound will decompose into its constituents. On the other hand, if the pressure in the chamber is higher than the dis-association pressure of the compound, a vacuum heat treatment will have virtually no effect. Fortunately, many of the metallic oxides, such as copper oxide are stable and it is necessary to go to extremely low pressures and higher normal temperatures before complete dis-association is effected.

I claim as my invention:

1. A sintered apex seal, for use in a rotary internal combustion engine, comprising:

a. a sintered powdered body effective to be resiliently urged into dynamic rubbing sealing engagement with another surface of said engine, said body being particularly characterized by a copper matrix containing by weight 0.1–0.6% chromium and free carbon in the range of 0.5–1.5%, said chromium substantially being in a precipitate form in said copper matrix rendering a surface hardenability level for said compact in the range of 50–75 $R_B$.

2. A method of fabricating a sintered seal, comprising:

a. preparing a pre-alloyed metal powder consisting of a copper base having an addition of 0.1–0.6% chromium by weight, said pre-alloyed powder having a particle size in the range of 100–325 mesh, b. preparing free carbon powder having a particle size in the range of 100–325 mesh and blending said free carbon powder with said pre-alloyed powder to form a powder mixture, c. compacting said mixture while in the heated condition in the range of 300°–1800°F, to a density of at least 60%, d. subjecting said compact to a sintering operation in a vacuum or hydrogen atmosphere at a temperature at least 1500°F and quenching said compact to retain the chromium in solution, and e. subjecting said sintered compact to a curing temperature in the range of 400°–600°F effective to precipitate the chromium in said copper base powder to form a precipitation hardened copper alloy material.

3. The method as in claim 2, in which the particle size of said pre-alloyed powder and graphite are each maintained in the narrower range of 200–325 mesh and the density to which said compact is reduced is controlled in the range of 80–90% whereby the thermal expansion characteristic of said sintered compact is regulated so as to be less than 0.01 inch.

4. The method as in claim 2, in which the sintering temperature is in excess of 2050°F.

* * * * *